US009777544B2

(12) United States Patent
Skjaerseth et al.

(10) Patent No.: US 9,777,544 B2
(45) Date of Patent: Oct. 3, 2017

(54) CONTINUOUS DRILLING FLUID CIRCULATION UNIT AND ARRANGEMENT

(71) Applicant: West Drilling Products AS, Stavanger (NO)

(72) Inventors: Odd B. Skjaerseth, Stavanger (NO); Bjorn Eilertsen, Hundvag (NO)

(73) Assignee: West Drilling Products AS, Stavanger (NO)

( * ) Notice: Subject to any disclaimer, the term of this patent is extended or adjusted under 35 U.S.C. 154(b) by 61 days.

(21) Appl. No.: 14/782,707

(22) PCT Filed: Apr. 3, 2014

(86) PCT No.: PCT/NO2014/050047

§ 371 (c)(1),
(2) Date: Oct. 6, 2015

(87) PCT Pub. No.: WO2014/168482

PCT Pub. Date: Oct. 16, 2014

(65) Prior Publication Data

US 2016/0040490 A1 Feb. 11, 2016

(30) Foreign Application Priority Data

Apr. 8, 2013 (NO) ..... 20130469

(51) Int. Cl.
*E21B 19/16* (2006.01)
*E21B 21/01* (2006.01)
(Continued)

(52) U.S. Cl.
CPC ..... *E21B 21/01* (2013.01); *E21B 21/08* (2013.01); *E21B 21/106* (2013.01); *E21B 19/16* (2013.01)

(58) Field of Classification Search
CPC ..... E21B 21/01; E21B 21/08; E21B 21/106; E21B 19/16
(Continued)

(56) References Cited

U.S. PATENT DOCUMENTS 2,207,149 A * 7/1940 Hild ..... E21B 33/06 166/86.1
3,994,350 A 11/1976 Smith et al.
(Continued)

FOREIGN PATENT DOCUMENTS

GB 2399112 A 9/2004
NO 326427 4/2011
(Continued)

OTHER PUBLICATIONS

International Search Report, PCT/NO2014/050047, dated Aug. 22, 2014.
(Continued)

*Primary Examiner* — Taras P Bemko
(74) *Attorney, Agent, or Firm* — Andrus Intellectual Property Law, LLP

(57) ABSTRACT

A circulation unit and an arrangement are arranged to continuously circulate drilling fluid during drilling. A housing is provided with a center bore arranged to accommodate a portion of a pipe. The center bore includes upper and lower sealing elements. The sealing elements are provided with center openings which, by the expansion of said sealing elements, are closable or fit tightly against the pipe by the abutment of an inner sealing surface against the pipe. Each of the sealing elements is connected in a fluid-tight manner to a packing pipe which is located in the housing and which is rotatable around the center axis of the center bore. The
(Continued)

packing pipe is surrounded by a packing assembly fitting tightly between the periphery of the packing pipe and the housing.

10 Claims, 3 Drawing Sheets

(51) Int. Cl.
*E21B 21/08* (2006.01)
*E21B 21/10* (2006.01)

(58) Field of Classification Search
USPC ..... 175/214, 218
See application file for complete search history.

(56) References Cited

U.S. PATENT DOCUMENTS

| | | | | |
|---|---|---|---|---|
| 4,449,596 | A | 5/1984 | Boyadjieff | |
| 6,209,663 | B1 * | 4/2001 | Hosie | E21B 21/08 166/332.8 |
| 6,412,554 | B1 | 7/2002 | Allen et al. | |
| 6,591,916 | B1 | 7/2003 | Ayling | |
| 6,688,394 | B1 | 2/2004 | Ayling | |
| 7,107,875 | B2 | 9/2006 | Haugen et al. | |
| 2002/0134555 | A1 * | 9/2002 | Allen | E21B 3/04 166/377 |
| 2003/0075023 | A1 | 4/2003 | Robichaux | |
| 2003/0221519 | A1 | 12/2003 | Haugen | |
| 2010/0145152 | A1 * | 6/2010 | Smith | A61B 17/3423 600/208 |
| 2013/0192895 | A1 * | 8/2013 | Krohn | E21B 3/02 175/57 |

FOREIGN PATENT DOCUMENTS

| | | |
|---|---|---|
| NO | 20100123 | 7/2011 |
| NO | 333021 | 2/2013 |
| WO | 01/69034 | 9/2001 |
| WO | 0236928 | 5/2002 |
| WO | 2008/147210 | 12/2008 |
| WO | 2011/093716 | 8/2011 |

OTHER PUBLICATIONS

Written Opinion, PCT/NO2014/050047, dated Aug. 14, 2014.
International Search Report, PCT/NO2011/000028, dated Apr. 4, 2011.
Written Opinion, PCT/NO2011/000028, dated Apr. 4, 2011.
International Search Report and Written Opinion for PCT/NO2013/050107, dated Sep. 20, 2013.
International Search Report, PCT/NO2013/050107, dated Sep. 20, 2013.
Written Opinion, PCT/NO2013/050107, dated Sep. 20, 2013.

* cited by examiner

CONTINUOUS DRILLING FLUID CIRCULATION UNIT AND ARRANGEMENT

CROSS-REFERENCE TO RELATED APPLICATIONS

This application is the U.S. national stage application of International Application PCT/NO2014/050057, filed Apr. 3, 2014, which international application was published on Oct. 16, 2014, as International Publication WO 2014/168482 in the English language. The international application is incorporated herein by reference, in entirety. The international application claims priority to Norwegian Patent Application No. 20130469, filed Apr. 8, 2013, which is incorporated herein by reference, in entirety.

FIELD

A circulation unit and an arrangement for the continuous circulation of drilling fluid during continuous drilling are described, in which a circulation unit is arranged between upper and lower rotary units, the circulation unit and the rotary units being vertically displaceable along a guide track.

BACKGROUND

It is known within the oil- and gas-drilling industry to take measures to be able to maintain a circulation of drilling fluid in the borehole while a drill string is being lengthened. NO 326427 discloses a system in which a top-drive drilling machine with a hollow drive shaft cooperates with a gate chamber provided with seals surrounding the pipe, in which the drilling fluid is passed alternately through the drive shaft via a first fluid inlet, when a continuous drill string is connected to the drilling machine, and through the gate chamber via a second fluid inlet, when the upper end of the pipe string is arranged in the gate chamber and is to be joined to a new pipe section.

A drawback of the prior art of NO 326427 is that the pipe-string rotation ceases when the pipe string is to be lengthened. It is known in the industry that it is an advantage to maintain the pipe-string rotation both to reduce the risk of the pipe string sticking and to improve the productivity, for example increase the drilling capacity by there being no stop in the actual drilling operation while the drill string is being lengthened.

From the NO patent 333021 and the corresponding WO publication 2011/093716, an arrangement is known, in which, between a first top-drive drilling machine and a borehole, are arranged a second drilling machine provided with a rotary table arranged to take the weight of a pipe string, a rotary-drive unit arranged to continuously rotate the pipe string, and a fluid chamber which is arranged to connect a pipe-string end portion in a fluid-communicating manner to a drilling-fluid system, the fluid chamber being provided with pipe-string ports including means arranged to close the pipe-string ports in a fluid-sealing manner, and the second drilling machine further being provided with a pair of power tongs which is arranged to connect/disconnect an element to/from the pipe string, the power tongs being arranged in the fluid chamber. The drawback of this arrangement is that the rotary-drive unit is directly connected to the fluid chamber (gate chamber) and the power tongs are enclosed in the fluid chamber. Here, the adjustment of the power tongs to the relevant pipe dimension that is being handled must take place by intervention in the fluid chamber.

From WO0169034 A2, a system is known, for the continuous circulation of fluid to and through a pipe string while an upper pipe is connected to or removed from the upper end of the pipe string. The system includes upper and lower chambers, each provided with a sealing device, which is arranged to rest sealingly against a portion of the pipe string, and with an intermediate gate apparatus.

WO 2008/147210 A2 discloses a device for a top-drive drilling machine, in which a continuous circulation of drilling fluid through a drill string may be maintained by the drilling fluid being supplied alternately through a chamber, fitting tightly against an upper portion of the drill string, and the drilling-machine drive shaft when the lower end portion thereof or of a connected pipe section opens into the chamber.

US 2003/0221519 A1 discloses an apparatus allowing the connection or disconnection of pipes relative to a pipe string during a drilling operation. The apparatus also allows the rotation and axial displacement of the pipe during the connection and disconnection operations and the circulation of drilling fluid. A top-drive drilling machine cooperates with a rotary table, and the drilling-fluid circulation is provided alternately through a circulation unit and through the top-drive drilling machine and the connected, upper pipe.

SUMMARY

The invention has for its object to remedy or reduce at least one of the drawbacks of the prior art or at least provide a useful alternative to the prior art.

The object is achieved through features, which are specified in the description below and in the claims that follow.

In what follows, the term "drill string" is used as a collective term for all types of pipe strings that, by rotation of an end portion, form a borehole in the underground by suitable drill-bit elements grinding the underground material and an inflowing drilling fluid carrying the ground underground material out of the borehole by means of a return flow to the surface.

Unless it is explicitly mentioned, the term "pipe" is used, in what follows, as a collective term for individual pipes, pipe sections made of several individual pipes, and a pipe string made by joining several individual pipes or several pipe sections that can be screwed together. "Pipe" may also cover a so-called saver sub, which is used as a connection between the pipe string and a rotary unit, possibly arranged for supplying drilling fluid to the pipe string.

According to a first aspect of the invention, a circulation unit for an arrangement arranged for continuously circulating drilling fluid during drilling has been provided, in which a housing is provided with a center bore arranged to accommodate a portion of a pipe, and in which the center bore includes upper and lower sealing elements, the sealing elements being provided with center openings which are closable or seal tightly against the pipe by the expansion of the sealing elements, by inner sealing surfaces resting against the pipe, the circulation element being characterized by each of the sealing elements being connected in a fluid-tight manner to a packing pipe which is in the housing and which is rotatable around the center axis of the center bore, and the packing pipe being surrounded by a packing assembly fitting tightly between the periphery of the packing pipe and the housing.

Under rotation, a drill string extending through the circulation unit will pull with it the sealing elements and the packing pipe, which thereby co-rotate with the drill string. The packing pipe may be a divided one.

At least one of the sealing elements may be provided with a self-closing pipe lead-through. In a preferred exemplary embodiment, the self-closing pipe lead-through consists of an elastic, conical element, which, in its closed state, is pressed together by an external pressure from fluid in an adjacent fluid chamber. When a pipe is pushed into the self-closing pipe lead-through, the pipe lead-through will open elastically and seal against the pipe.

The self-closing pipe lead-through constitutes an additional barrier in relation to the adjacent sealing element.

The self-closing pipe lead-through may be made from a yielding material, or an elastic material or a combination thereof, for example rubberlike materials, springs, bladders filled with pressurized fluid or combinations thereof.

Between two packing assemblies, a fluid port, which is in fluid communication with the sealing elements, may be arranged. The space in the housing between the packing assemblies and two sealing elements forms a fluid chamber.

The packing pipe may be connected to a drain column projecting upwards from the packing pipe. The purpose of the drain column is to dampen the outflow of fluid from a fluid-filled pipe, which is being disconnected from a drill string.

According to a second aspect of the invention, an arrangement for the continuous circulation of drilling fluid during continuous drilling is provided, in which a circulation unit as described above is arranged between upper and lower rotary units, the circulation unit and the rotary units being vertically displaceable along a guide track, the arrangement being characterized by at least the upper rotary unit being displaceable independently of the circulation unit, and the circulation unit including a housing which is provided with a center bore arranged to accommodate a portion of a pipe, and the center bore including upper and lower annular sealing elements which are rotatably supported in the housing, and the sealing elements being provided with center openings which are closable or fit tightly against the pipe by the expansion of the sealing elements, by inner sealing surfaces abutting against the pipe.

Any rotation of a drill string and any rotation of a pipe during connection to or separation from the drill string are provided by rotatable tongs arranged outside the housing of the circulation unit.

Each of the rotary units typically includes a pair of rotatable tongs of the kind that can grip around a pipe portion and hold it firmly, a hanging-off device, typically in the form of a slips arrangement, of a kind known per se, arranged to rest against a downward-facing shoulder portion of a pipe socket or the like, and a rotary bearing which is arranged to support the tongs and/or the hanging-off device. The rotatable tongs are provided with a rotary drive.

The rotary units are arranged to absorb the prevailing forces in the drill string and forces arising within the circulation unit. The forces arising within the circulation unit and being caused by fluid pressure, among other things, may constitute both compressive forces and tensile forces in a connection/disconnection situation.

The lower rotary unit and the circulation unit may be provided with a shared linear drive, which is arranged to displace the rotary unit and circulation unit in a synchronous vertical movement along the guide track.

The circulation unit may be provided with a fluid chamber and a drain housing, which are each connected to a drilling-fluid plant via individually closable drilling-fluid lines connected to a valve system.

A saver sub may be rotatably connected to a closable drilling-fluid line, which is connected to the drilling-fluid plant via the valve system.

The sealing elements are connected in a fluid-tight manner to the rotatable packing pipe which is in the housing and which is surrounded by a packing assembly fitting tightly against the periphery of the packing pipe and against the housing.

A drilling operation with continuous drilling circulation and continuous drill-string rotation according to the invention may typically be performed in the following manner:

1. In a first phase of a drilling sequence, the following takes place:
   a) An upper end of the drill string projects up through the circulation unit. A first drilling-fluid line has been connected via the saver sub to the upper end of the drill string.
   b) Drilling fluid is supplied to a center bore of the drill string via the saver sub.
   c) The drill string is kept in rotation by the upper rotary unit.
   d) The upper and lower sealing elements are open, and the drill string is moved substantially freely relative to the circulation unit.
   e) The upper rotary unit and the drill string are displaced downwards according to the drilling rate achieved.

2. In a second phase of the drilling sequence, the following takes place:
   a) The circulation unit and the lower rotary unit are displaced upwards towards the upper rotary unit.
   b) The upper end of the drill string and a lower portion of the saver sub are moved into the circulation unit, so that the upper end of the drill string is in the fluid chamber.
   c) The drill string is gripped by the lower rotary unit, which takes over the drill-string rotation. The saver sub remains hung off in the upper rotary unit. The sealing elements close around the rotating drill string and the saver sub, respectively.
   d) Drilling fluid is supplied to the fluid chamber through the fluid port. The saver sub is disconnected from the drill string by the upper rotary unit holding back the saver sub while the lower rotary unit rotates the drill string. The saver sub is withdrawn from the fluid chamber as the self-closing pipe lead-through closes behind the pipe, and the supply of drilling fluid through the saver sub is stopped.
   e) Drilling fluid is drained from the saver sub and the saver sub is withdrawn from the circulation unit.
   f) The drilling operation is maintained by rotating and displacing the lower rotary unit and the circulation unit, and the supply of drilling fluid is maintained through the fluid chamber, which is kept closed to the surroundings by means of the self-closing pipe lead-through, possibly the upper sealing element and the lower sealing element, which fit tightly around a portion of the drill string.

3. In a third phase of the drilling sequence, the following takes place:
   a) The next pipe to be connected to the drill string is moved in, by means of a manipulator or the like, to the drilling center, which coincides with the center axis of the circulation unit, and is held fixed there.
   b) The upper rotary unit rotates the saver sub to connect it to the upper end of the pipe.
   c) The pipe is moved with its lower end into the circulation unit while the upper sealing element is open and further into the self-closing pipe lead-through, which opens sufficiently for the pipe to be moved through.

d) The upper sealing element is closed around the pipe.

e) Drilling fluid is supplied through the saver sub, and the supply of drilling fluid through the fluid port is stopped, as the drill string is now supplied with drilling fluid from the saver sub.

f) Under rotation, the upper rotary unit displaces the pipe to connect it to the drill string, the pipe being rotated faster than the drill string.

g) Drilling fluid is supplied to the drill string through the saver sub. The sealing elements are opened, possibly after the fluid chamber of the circulation unit has been drained.

The drilling operation continues by steps 1a)-3g) being repeated.

The drilling operation may also be carried out with variants deviating somewhat from what has been described above without departing from the scope of the invention.

It represents a considerable simplification of the operation and maintenance of systems for continuous drilling-fluid circulation during the continuous rotation of a drill string in that all the elements that provide rotation and hanging-off of a pipe or drill string are arranged outside the circulation unit. Any replacement of components in connection with maintenance or adjustment to another pipe dimension may be carried out without intervention in the circulation unit.

The arrangement according to the invention exhibits a great degree of flexibility in continuous drilling-fluid circulation during the continuous rotation of a drill string, in that the upper rotary unit may be displaced independently of the lower rotary unit and the circulation unit. Further flexibility may be achieved by the lower rotary unit being displaceable independently of the circulation unit.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
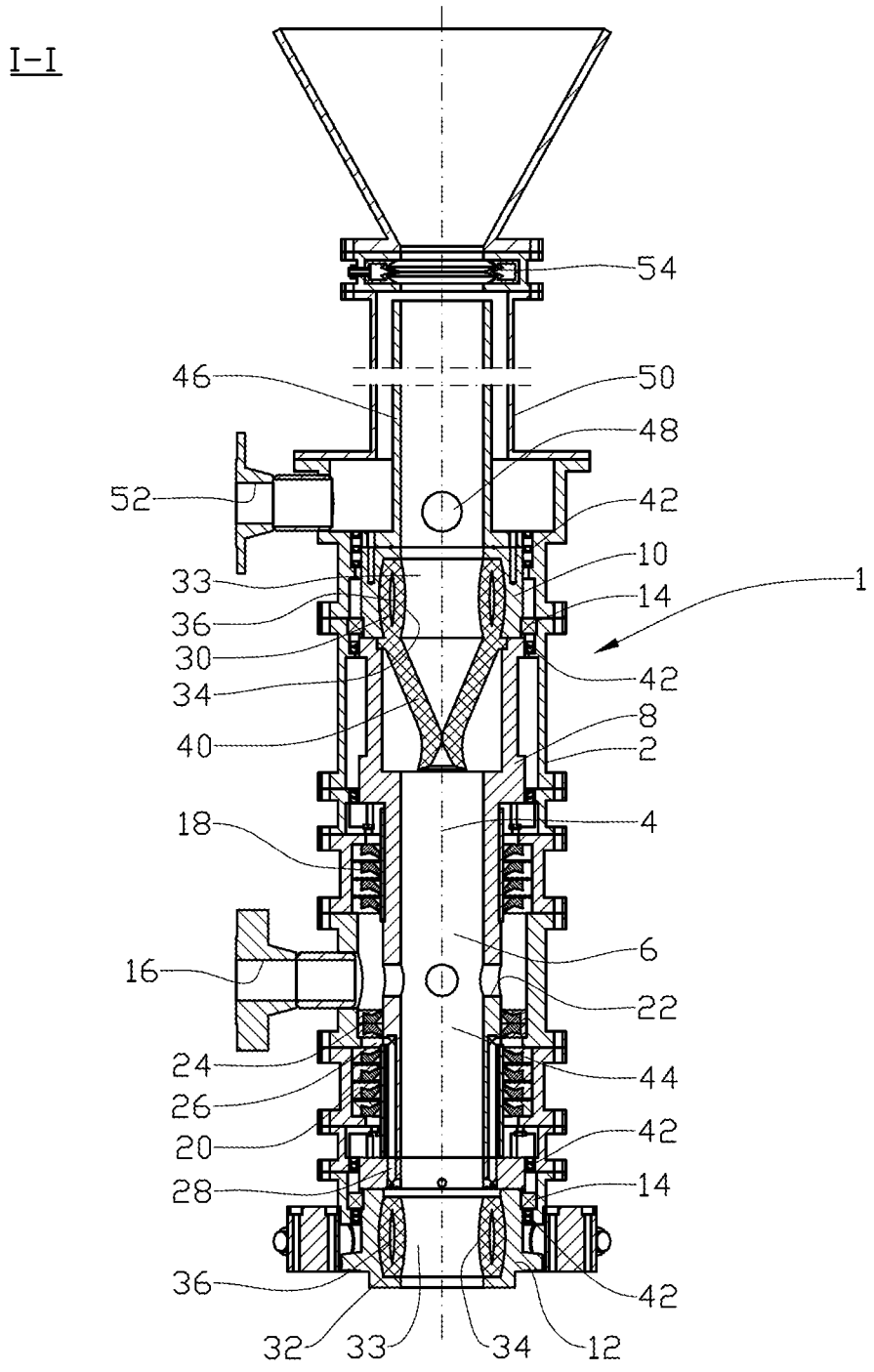
FIG. 1 shows an axial section through a circulation unit in accordance with the invention, such section being taken on line I-I of FIG. 2.

In the drawings, the reference numeral 1 indicates a circulation unit including a housing 2, the circulation unit 1 being formed with an axial center bore 4 extending through it. The center axis of the center bore 4 coincides, in the main, with a drilling center 6. The reference numeral 6 is therefore used both for the center axis and for the drilling center.

A packing pipe 8 is arranged centrally in the housing 2 and is attached at its end portions to an upper bearing ring 10 and a lower bearing ring 12, respectively. At both bearing rings 10, 12 a bearing 14 against the housing 2 is arranged. The bearings 14, which have the effect of making the packing pipe 8 with the bearing rings 10, 12 rotatable in the housing 2, are arranged to absorb any radial and axial forces that arise.

Above and below a fluid port 16, which is in fluid communication with the housing 2, an upper packing assembly 18 and a lower packing assembly 20, respectively, are arranged, sealing between the housing 2 and the packing pipe 8. The packing assemblies 18, 20 may typically be so-called "wash-pipe packings", but other known suitable seals may be used as well.

Radial openings 22 are arranged in the packing pipe 8 between the packing assemblies 18, 20.

An evacuation packing 24 surrounding the packing pipe 8 in the region between the fluid port 16 and the lower packing assembly 20 defines an annular space 26. An evacuation channel 28 in the packing pipe 8 extends from the annular space 26 to the lower portion of the packing pipe 8. An evacuation pump, not shown, is connected to the annular space 26 and is arranged to drain the circulation unit 1 via the annular space 26 and the evacuation channel 28.

The upper bearing ring 10 is provided with an upper sealing element 30 internally. In the same way, the lower bearing ring 12 is provided with a lower sealing element 32 internally.

Figure 2:
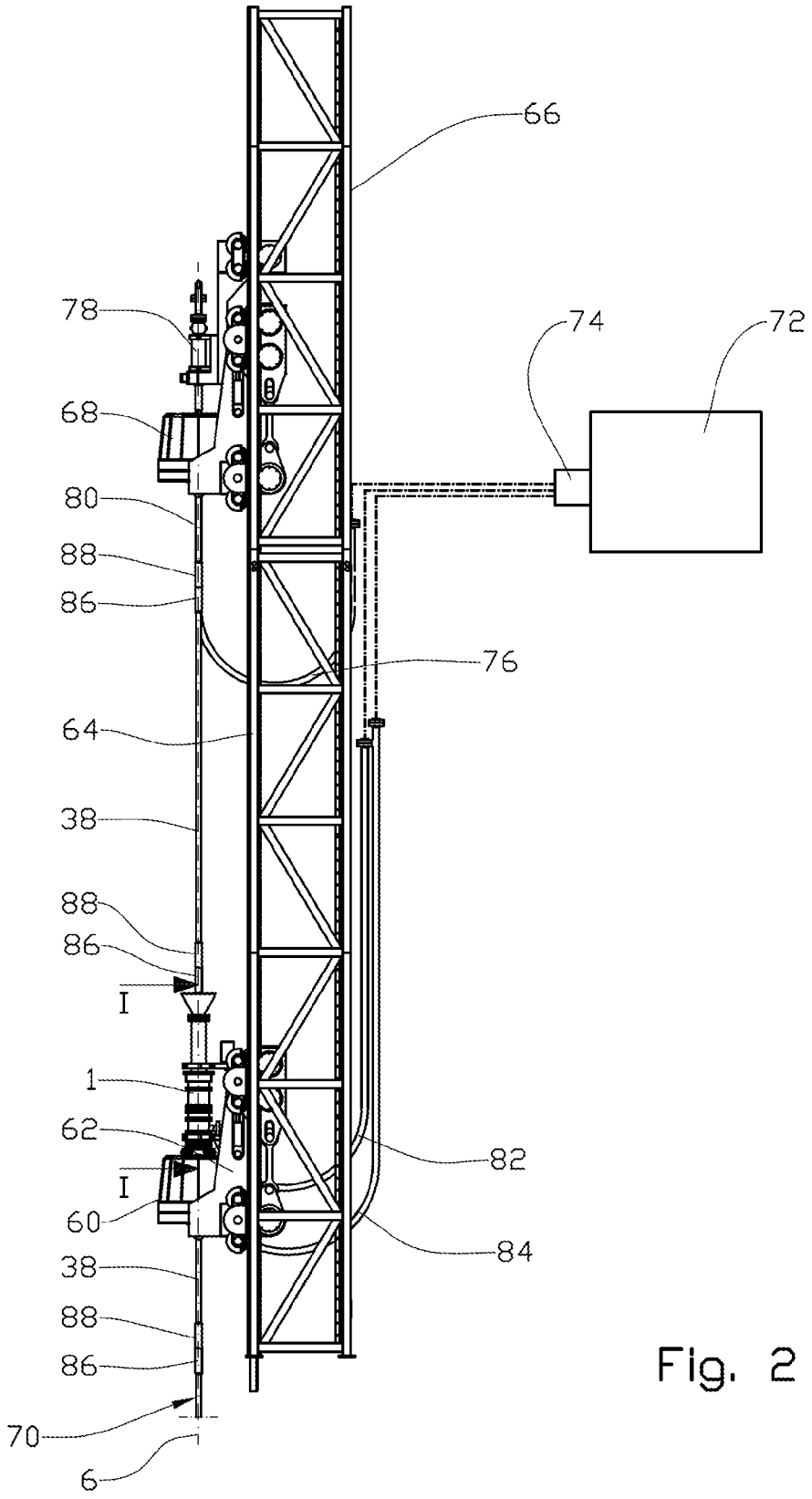
FIG. 2 shows a side view on a smaller scale of an arrangement according to the invention, in which a drill string is rotated by an upper rotary unit and drilling fluid is supplied via a saver sub connected to the drill string, while a circulation unit and a lower rotary unit are being displaced vertically towards the upper rotary unit.

The sealing elements 30, 32 are formed with inner center openings 33, which have sealing surfaces 34, and expansion chambers 36, which are in fluid communication with a pressure-fluid pump, not shown, via swivel couplings and valves, not shown. By supplying pressurized fluid to the expansion chambers 36, the respective sealing elements 30, 32 may be brought to close, alternatively bring the inner sealing surfaces 34 to seal against a pipe 38. The pipe 38 is shown in FIG. 2. The sealing elements 30, 32 are prevented from being displaced axially in their respective bearing rings 10, 12.

In this preferred embodiment, the upper sealing element 30 is provided with a self-closing pipe lead-through 40. The self-closing pipe lead-through 40 has the form of an elastic cone projecting from the upper sealing element 30 and having a decreasing cross section in the direction of the lower sealing element 32. The self-closing pipe lead-through 40 is arranged to be fluid-tight when there is no pipe 38 in it and to rest sealingly against a pipe 38 when the pipe 38 extends through it. Fluid pressure against the outside of the self-closing pipe lead-through 40 helps to press it together or against the pipe 38.

A number of packings 42 between the packing pipe 8 including the bearing rings 10, 12 and the housing 2 are arranged to, among other things, prevent an undesired ingress of fluid to the bearings 14.

A volume in the housing 2 defined by the packing assemblies 18, 20 and the sealing elements 30, 32 constitutes a fluid chamber 44, which is in fluid communication with the fluid port 16.

A tubular drain column 46 is connected to the upper bearing ring 10 and co-rotates therewith. The drain column 46 is provided with radial drain openings 48 in its lower portion. The purpose of the drain column 46 is to dampen the outflow of drilling fluid from a pipe 38 during disconnection.

From the housing 2, a drain housing 50 projects upwards, surrounding the drain column 46. At its lower portion, the drain housing 50 is connected to a drain port 52, whereas the drain housing 50 is provided with an expandable sealing/scraper valve 54 of a design known per se at its upper portion.

Reference is now made to FIG. 2. The circulation unit 1 is connected together with a lower rotary unit 60 to a linear drive 62, which is arranged to displace the circulation unit 1 and the rotary unit 60 vertically along a guide track 64 in a derrick 66.

Here, an upper rotary unit 68 runs along the same guide track 64. The rotary units 60, 68, which normally comprise tongs, not shown, and a hanging-off device, are of designs known per se and are arranged to be able to hold and also rotate a drill string 70 around the drilling center 6.

A drilling-fluid plant 72 with an associated valve system 74 is connected by means of a first drilling-fluid line 76 via a swivel coupling 78 to a saver sub 80, which is in the upper rotary unit 68, by means of a second drilling-fluid line 82 to the drain port 52 and by means of a third drilling-fluid line 84 to the fluid port 16.

The drill string 70 includes a number of pipes 38, which are screwed together in a manner known per se by means of an upper coupling 86 and a lower coupling 88. The saver sub 80 is formed with a lower coupling 88.

When a continuous drilling operation is being performed with the arrangement according to the invention, it may be performed in the following manner:

In a first phase of a drilling sequence, the drill string 70 projects up through the circulation unit 1. The first drilling-fluid line 76 is connected via the swivel coupling 78 and the saver sub 80 to the drill string 70. Drilling fluid is supplied to the drill string 70 via the saver sub 80. The drill string 70 is kept in rotation by the upper rotary unit 68. The upper and lower sealing elements 30, 32 are open while the self-closing pipe lead-through 40 rests against the drill string 70, and the drill string 70 can be moved relatively freely relative to the circulation unit 1. The upper rotary unit 68 and the drill string 70 are moved downwards according to the drilling rate achieved.

Figure 3:
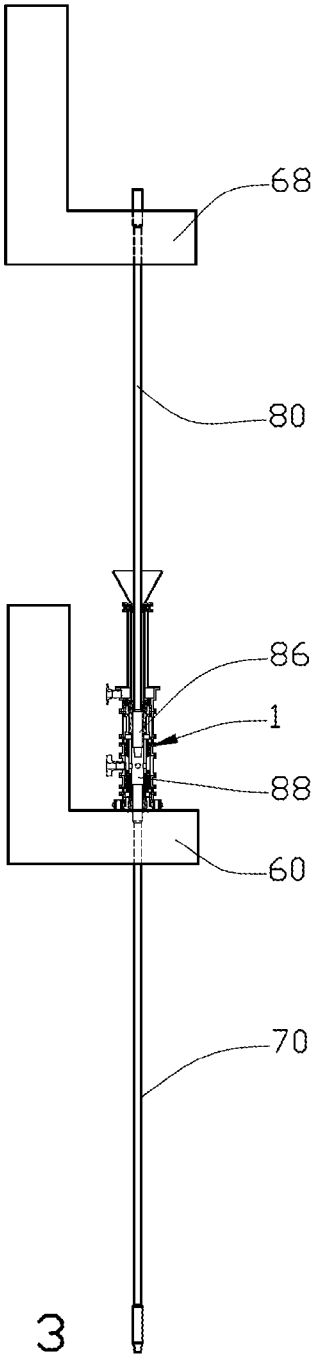
FIG. 3 shows a principle drawing of the arrangement according to the invention with an axial section through the circulation unit, in which the upper end of the drill string is positioned in a fluid chamber in the circulation unit and the saver sub is disconnected from the drill string and has its lower end positioned in the fluid chamber, the drill string being rotated by the lower rotary unit and drilling fluid being supplied through the fluid chamber of circulation unit.
Figure 4:
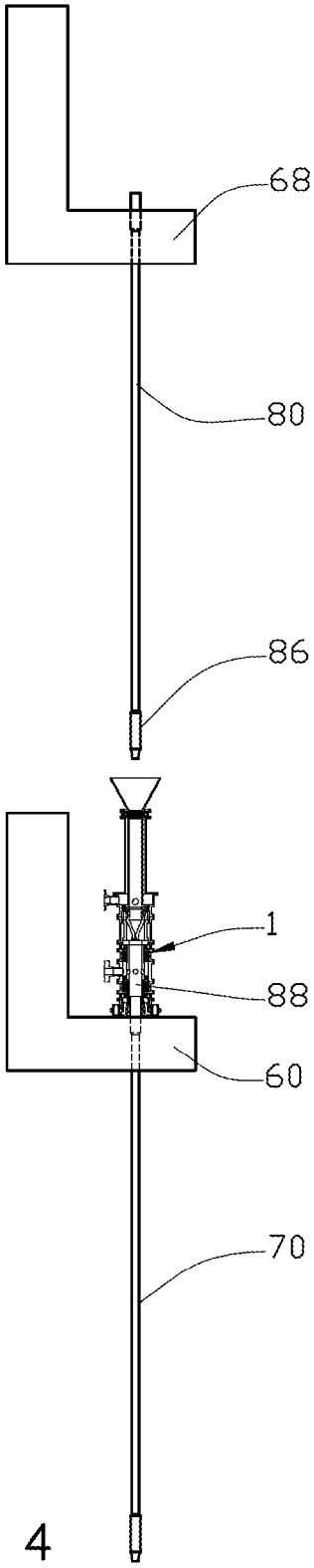
FIG. 4 shows the drill string in continued rotation by the lower rotary unit, and the saver sub withdrawn from the circulation unit.

In a second phase of the drilling sequence, the circulation unit 1 and the lower rotary unit 60 are moved upwards towards the upper rotary unit 68. The upper coupling 86 of the upper pipe 38 of the drill string 70 and the lower coupling 88 of the saver sub 80 are moved into the fluid chamber 44 of the circulation unit 1. The drill string 70 is gripped by the lower rotary unit 60, which takes over the drill-string rotation. The saver sub 80 remains hung off in the upper rotary unit 68. The sealing elements 30, 32 are closed around the rotating drill string 70 and the saver sub 80, respectively. Drilling fluid is supplied to the fluid chamber 44 through the fluid port 16. The saver sub 80 is disconnected from the drill string 70 by the upper rotary unit 68 holding the saver sub 80 back while the lower rotary unit 60 is rotating the drill string 70, see FIG. 3. The supply of drilling fluid to the saver sub 80 is stopped. The saver sub 80 is pulled out of the fluid chamber 44 while, at the same time, the self-closing pipe lead-through 40 closes behind the saver sub 80. The upper sealing element 30 is opened and the saver sub 80 is withdrawn from the circulation unit 1 while draining at the same time via the drain port 52, see FIG. 4. The drilling operation is maintained by the rotation and displacement of the lower rotary unit 60 and the circulation unit 1, and the supply of drilling fluid is maintained through the fluid chamber 44, which is kept closed to the surroundings by means of the self-closing pipe lead-through 40 and the lower sealing element 32 fitting tightly around a portion of the drill string 70.

In a third phase of the drilling sequence, a next pipe 38, which is to be joined to the drill string 70 is moved by means of a manipulator (not shown) or the like into the drilling center 6 and held fixed there. The upper rotary unit 68 rotates the saver sub 89 to connect it to the upper coupling 86 of the pipe 38. The pipe 38 is displaced by its lower coupling 88 into the circulation unit 1 while the upper sealing element 30 is open. The upper sealing element 30 closes around the pipe 38. Further displacement of the pipe 38 opens the self-closing pipe lead-through 40. Drilling fluid is supplied to the pipe 38 through the saver sub 80, after which the supply of drilling fluid through the fluid port 16 is stopped, the drill string 70 now being supplied with drilling fluid through the saver sub 80. Under rotation, the upper rotary unit 68 moves the pipe 38 to connect it to the drill string 70, the pipe 38 being rotated faster than the drill string 70. Drilling fluid is supplied to the drill string 70 through the saver sub 80. The sealing elements 30, 32 are opened, possibly after the fluid chamber 44 of the circulation unit 1 has been drained through the evacuation channel 28.

The drilling operation continues by repetition from phase 1 by successively connecting new pipes 38 as the drill string 70 works its way into the underground.

By means of the arrangement according to the invention, a simple system for continuous drilling-fluid supply during drilling is provided, and the drilling may be carried out under continuous progress. The central units used are uncomplicated as only one main function has been assigned to each of the units, namely:

a) The upper rotary unit 68 performs the hanging off, rotation and vertical displacement of the drill string 70 or a pipe connected to the saver sub 80.

b) The lower rotary unit 60 performs the hanging off, rotation and vertical displacement of the drill string 70.

c) The circulation unit 1 performs fluid-tight, displaceable coupling between a drilling-fluid plant 72 and the rotating drill string 70 in cooperation with the saver sub 80 for shifting the drilling-fluid supply between a supply directly to the drill string 70 and a supply via the next pipe 38 in the connection phase.

The circulation unit 1 in accordance with the invention provides an environmentally friendly handling of the drilling fluid, as any residual amounts of drilling fluid may be drained from the circulation unit 1 before the sealing elements 30, 32 are released from the drill string 70 et cetera. The packing assemblies 18, 20 of the circulation unit 1 also ensure an improved durability of bearings 14 and so on by the pressure fluid, which usually also functions as a lubricant for the bearings 14, not so easily becoming contaminated with drilling fluid as the drilling fluid is prevented by the packings 42 from penetrating into the bearings 14.

By using a circulation unit 1, which has for its task only to maintain the supply of drilling fluid to the drill string 70 independently of the hanging-off and the vertical displacement of the drill string 70 and pipe 38 which is performed by the rotary units 60, 68, the adjustment of the arrangement for other pipe dimensions may be done more rationally as no intervention is needed into the closed circulation unit 1 when gripping elements and so on in the rotatable tongs and hanging-off devices, not shown, are to be replaced.

By separating the circulation unit 1 from the lower rotary unit 60 by the circulation unit being provided with a separate linear drive, not shown, for vertically displacing the circulation unit 1 independently of the second rotary unit 60, further advantages may be achieved in consequence of greater operational freedom during continuous drilling with continuous drilling-fluid circulation.

The invention claimed is:

1. A circulation unit for an arrangement arranged to continuously circulate drilling fluid during drilling, in which a housing is provided with a center bore arranged to accommodate a portion of a pipe;

the center bore includes upper and lower sealing elements;

wherein each of the upper and lower sealing elements is provided with a center opening which, by expansion from within each of the upper and lower sealing elements into the center opening, is closable, or each of the upper and lower sealing elements due to the expansion therein fits tightly against the pipe by abutment of an inner sealing surface against the pipe, wherein each of the upper and lower sealing elements is connected in a fluid-tight manner to a packing pipe which is located in the housing and which is rotatable around the center axis of the center bore, and the packing pipe is surrounded by a packing assembly fitting tightly between the periphery of the packing pipe and the housing, and wherein an additional sealing element projects from at least one of the upper and lower sealing elements into a fluid chamber formed in the packing pipe, and is configured to close the center bore or fit tightly against the pipe by pressure from a fluid in the fluid chamber acting externally on the additional sealing element.

2. The circulation unit in accordance with claim 1, wherein the additional sealing element is provided with a self-closing pipe lead-through.

3. The circulation unit in accordance with claim 2, wherein additional sealing element is formed as a cone made from a yielding material, or an elastic material or a combination thereof.

4. The circulation unit in accordance with claim 1, wherein, between two packing assemblies, a fluid port is arranged, which is in fluid communication with the upper and lower sealing elements.

5. The circulation unit in accordance with claim 1, wherein the packing pipe is connected to a drain column projecting upwards from the packing pipe.

6. An arrangement for the continuous circulation of drilling fluid during continuous drilling, in which a circulation unit arranged between lower and upper rotary units, the circulation unit and the rotary units being vertically displaceable along a guide track, wherein at least the upper rotary unit is displaceable independently of the circulation unit;

the circulation unit includes a housing provided with a center bore arranged to accommodate a portion of a pipe;

the center bore includes upper and lower annular sealing elements rotatably supported in the housing; and each of the upper and lower sealing elements is provided with a center opening which, by expansion from within each of the upper and lower sealing elements, is closable, or each of the upper and lower annular sealing elements due to the expansion therein fits tightly against the pipe by abutment of an inner sealing surface against the pipe, and wherein an additional sealing element projects from at least one of the upper and lower annular sealing elements into a fluid chamber formed between the upper and lower annular sealing elements, and is configured to close the center bore or fit tightly against the pipe by pressure from a fluid in the fluid chamber acting externally on the additional sealing element.

7. The arrangement in accordance with claim 6, wherein any rotation of a drill string and any rotation of a pipe during connection to or disconnection from the drill string are provided by rotatable tongs which are arranged outside the housing of the circulation unit.

8. The arrangement in accordance with claim 6, wherein the lower rotary unit and the circulation unit are provided with a shared linear drive which is arranged to displace the rotary unit and the circulation unit in a synchronous vertical movement along the guide track.

9. The arrangement in accordance with claim 6, wherein the fluid chamber and a drain housing are each connected to a drilling-fluid plant via individually closable drilling-fluid lines connected to a valve system.

10. The arrangement in accordance with claim 6, wherein a saver sub is rotatable connected to a closable first drilling-fluid line which is connected to the drilling-fluid plant via the valve system.

* * * * *